US005454664A

United States Patent [19]

Siblik

[11] Patent Number: 5,454,664

[45] Date of Patent: Oct. 3, 1995

[54] ROADWAY MARKER

[75] Inventor: Allen D. Siblik, Wadsworth, Ill.

[73] Assignee: Hallen Products Ltd., Wadsworth, Ill.

[21] Appl. No.: 225,970

[22] Filed: Apr. 7, 1994

[51] Int. Cl.[6] ..... E01F 9/06

[52] U.S. Cl. ..... 404/14; 404/16

[58] Field of Search ..... 404/9, 12, 13, 404/14, 15, 16

[56] References Cited

U.S. PATENT DOCUMENTS

| | | | |
|---|---|---|---|
| D. 270,143 | 8/1983 | Flanagan | D10/113 |
| 1,952,942 | 3/1934 | Ross . | |
| 2,126,224 | 8/1938 | Shaffer et al. . | |
| 2,146,359 | 2/1939 | Shaw . | |
| 2,185,488 | 1/1940 | White, Jr. . | |
| 3,485,148 | 12/1969 | Heenan . | |
| 3,587,416 | 7/1971 | Flanagan | 404/9 |
| 3,790,293 | 2/1974 | Heenan et al. | 404/15 |
| 3,809,487 | 5/1974 | Flanagan | 404/15 |
| 3,975,108 | 8/1976 | Suhr et al. | 404/16 |
| 4,147,447 | 4/1979 | Heenan et al. | 404/16 |
| 4,155,666 | 5/1979 | Flanagan | 404/16 |
| 4,195,945 | 4/1980 | Heenan | 404/16 |
| 4,232,979 | 11/1980 | Johnson, Jr. et al. | 404/16 |
| 4,557,624 | 12/1985 | Walker | 404/14 |
| 4,577,992 | 3/1986 | Jefferies | 404/16 |
| 4,634,310 | 1/1987 | Clarke | 404/15 |
| 4,659,248 | 4/1987 | Flanagan | 404/10 |
| 4,854,768 | 8/1989 | Flanagan et al. | 404/11 |
| 4,883,384 | 11/1989 | Hedgewick | 404/14 |
| 5,257,875 | 11/1993 | Flanagan | 404/12 X |
| 5,277,513 | 1/1994 | Flanagan et al. | 404/16 |

*Primary Examiner*—William P. Neuder
*Attorney, Agent, or Firm*—McCaleb, Lucas & Brugman

[57] ABSTRACT

A low profile, bi-directionally snow-plowable road marker having a cast metal base or body of generally square plan configuration formed on its underside with laterally spaced oppositely curved arcuate rib members flanked by transversely extending webs and protrusions located centrally of the body and acting with the rib members to self-center the cast body in a shallow arcuate depression of single radius formed in a roadway pavement; the webs and protrusions being configured to evenly distribute adhesive over the bottom, sides, ends and over portions of the upper side of the cast body to encapsulate and lock the same securely in the pavement depression. The upper side of the cast body is distinguished by a pair of downwardly sloping sub road surface vision ramps extending inwardly of opposite ends of the cast body and terminating at their lower ends in co-planar mounting platforms which are separated by a vertically extending wall having a transversely protruding and overhanging canopy portion along its upper end. A reflective light signal assembly is adapted to be mounted on either one or both of the platforms as selected; such being protectively captured and locked against vertical and lateral displacement by the overhanging canopy beneath which it is mounted. Locators having upper curvilinear surfaces and co-planar bottom surfaces are provided along opposite sides of the cast body to engage the roadway surface and thereby vertically locate the body casting in the pavement depression so that there is minimal protrusion of the marker above the roadway surface. The signal assemblies are protectively located on the bottom of the vision ramps and shielded from contact with vehicle tires and snowplow blades by the canopy.

8 Claims, 2 Drawing Sheets

ROADWAY MARKER

This invention relates generally to lighted pavement markers used to delineate highway traffic lanes and more particularly to very low profile pavement markers for presenting minimal interference with vehicular traffic and snow removal equipment, especially snow plows.

BACKGROUND OF THE INVENTION

Pavement markers for delineating highway traffic lanes by means of a series of spaced visible light signals have gained wide spread use. Such markers commonly employ reflector devices which reflect light emanating from the head lights of oncoming automotive road vehicles. In other instances electrically powered lamps are substituted for the reflectors to provide the necessary light source. It is intended herein that "light signal assemblies" as hereinafter described include light reflectors, electrical lamps or other equivalent light sources.

One popularly used highway marker of the prior art described in U.S. Pat. No. 4,147,447 issued Apr. 3, 1979, employs an H-shaped metal body having parallel upwardly extending inclined ramps which are anchored by parallel depending portions extending into elongated slots cut in the pavement of the highway and between which is a horizontal support on which are mounted light reflectors. The ramps serve to guide a snow plow blade or other snow removal equipment upwardly away from and over the top of the reflectors in an effort to avoid impact damage to the reflectors and the anchored marker while leaving the reflectors accessible to wiping action from overpassing vehicle tires.

However, such prior known structures fail to eliminate the damaging impact of a heavy snow plow blade travelling even at moderate speed when it encounters the marker's ramp obstructions, either head on or at an angle. Consequently, although widely used, such elevating ramp type marker structures are frequently torn from their moorings and/or the reflectors are broken and dislodged by snow removal equipment or the impact of normal vehicular traffic, rendering the marker assemblies ineffective for their intended purpose. Of similar importance is the impact damage to the snow plow blades created by the resistive characteristics of the raised ramp-type markers as well as other known marker structures of the prior art which project upwardly from the road surface a substantial distance.

SUMMARY OF THE INVENTION

The present invention is directed to an improved low profile road marker assembly which alleviates, among others, the aforedescribed problems related to raised ramp-type and similar known roadway markers that present objectional obstruction to vehicular traffic and snow removal equipment.

Briefly, the roadway marker of this invention comprises a compact, cast metal base or body adapted to be anchored by adhesive in a single relatively shallow, arcuate recess of single radius cut into the roadway pavement; such base being formed with a generally square plan profile and an arcuately curvilinear underside which fits freely into the pavement recess. Arcuate ribs, flanked medially by transversely related web and protrusion portions, extend downwardly beneath the underside of the base to locate and anchor the cast body in operating position in the road recess; the underside configuration of the body serving to distribute liquid adhesive throughout the recess and over the ribs, webs, sides and ends of the base casting. Locator buttons having co-planar undersurfaces and gently curved or crowned upper surfaces extend outwardly of opposite sides of side rails of the base for engaging the surface of the road whereby to vertically locate the base in the pavement recess. The upper side of the base is distinguished by the side rails having arcuate upper surfaces and a pair of below road surface vision ramps which extend angularly downwardly from opposite ends of the base to co-planar, platforms which extend across the lower ends of the ramps on opposite sides of a vertical separating wall. The upper end of such vertical wall is formed with a transversely projecting canopy which protectively overhangs major upper end portions of light signal assemblies located on either one or both of such platforms as selected. The light signals and vision ramps, extend generally below the roadway surface while the canopy and upper surface of the base lie on an arc extending above the roadway surface with the locators extending laterally over the roadway surface to provide minimal obstruction to vehicular traffic and snow removal equipment passing thereover.

It is an important object of this invention to provide an improved low-profile, snow plowable road marker for delineating highway traffic lanes.

It is another important object of this invention to provide an improved road marker as aforesaid embodying one or more light signal assemblies which are protectively mounted in positions generally below the road surface.

A still additional object of this invention is to provide a road marker for delineating highway traffic lanes and boundaries which is substantially self locating in an arcuate mounting depression cut at a single radius in the roadway.

Still another object of this invention is to provide a road marker having a cast metal body which is adapted to be held in an arcuate recess cut in the roadway by adhesive means encapsulating the bottom, side, and end portions of the body.

A further important object of this invention is to provide a road marker employing one or more light signal assemblies which are protectively interlocked with the body of the marker to prevent vertical, horizontal and lateral displacement thereof.

Still another object of this invention is to provide a highway road marker embodying light-reflective signal means which are protectively supported against compressive loading and engagement by vehicular traffic passing thereover.

A still additional object of this invention is to provide a road marker affording simplified and economical installation on paved roadways.

Having described this invention the above and further objects, features and advantages thereof will appear from the following detailed description of a preferred embodiment, illustrated in the accompanying drawing and representing the best mode presently contemplated for enabling those skilled in the art to practice this invention.

DESCRIPTION OF THE PREFERRED EMBODIMENT

Figure 1:
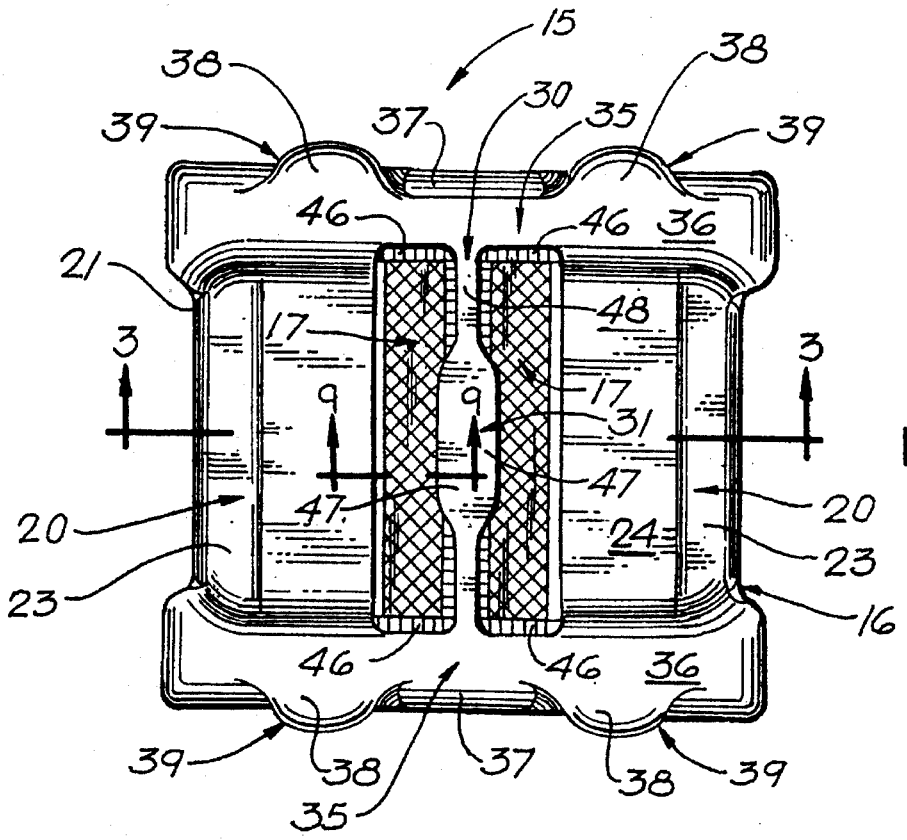
FIG. 1 is a top plan view of a preferred form of road marker according to this invention.
Figure 2:
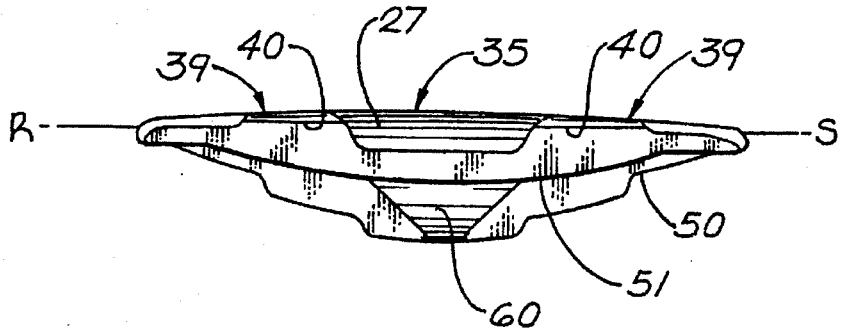
FIG. 2 is a side elevational view thereof in its installed position in a roadway.

Referring now to FIGS. 1–5 of the drawings, it will be understood that a preferred roadway marker assembly 15 according to this invention is therein illustrated as comprising a base or body 16 carrying one or more light signal assemblies 17.

Base 16 preferably is a relatively heavy, unitary metal casting of generally square plan configuration having two downwardly sloping symmetrically disposed and oppositely inclined vision ramps 20, 20 inset in its upper side. Such ramps extend from opposite ends 21, 21 of the base toward the middle thereof. In the particular embodiment illustrated, each vision ramp comprises a generally horizontal planar surface portion 23 adjacent its outer or elevated end and a downwardly sloping planar surface portion 24 which intersects surface portion 23 and terminates at its lower end at a recessed or depressed rectangular shaped mounting platform 25. The two mounting platforms so provided present coplanar and operatively horizontal surfaces 26 for undersupporting signal assemblies 17 mounted thereon.

Separating the two mounting platforms 25, 25 as above noted, is a vertically extending web wall 30 located on the transverse center line of the base and preferably cast integral therewith, Importantly a transversely extending canopy portion 31 extending part way along the central upper end of wall 30 partially overhangs the two mounting platforms 25. The canopy serves to protectively interlock with signal assemblies 17 mounted on the platforms 25 to prevent undesired vertical, horizontal and lateral displacement thereof. From FIG. 3 it will be recognized that the vertical extent of wall 30 and its canopy portion 31 is slightly above the level of the road surface, indicated at R-S in that figure and at the crest of the arcuate top side form of the base (see FIG. 3).

Laterally flanking the two mounting platforms 25, 25 and vision ramps 20, 20 are parallel linear side rail portions 35, 35 of the base having matching gently arcuate upper surfaces 36, 36 which are radiused downwardly at their opposite ends and crest at the transverse center line of the base coincident with the peak of the canopy 31.

Medially, surfaces 36, 36 are flanked along their outboard sides by angularly downward and generally planar sloping side surfaces 37, 37 which merge at their ends into gently crowned, semi-rounded surface formations 38 that project laterally outward from opposite sides of the base casting 16. These surfaces 38 form the upper sides of four locators or buttons 39 formed with co-planar undersurfaces 40, 40 arranged to engage the pavement surface R-S for the purpose of locating the base vertically in an arcuate cut-out or depression 45 formed at a single radius in the road surface R-S (see FIG. 2). The upward extent of the surfaces 38 merge with surface 36 of the side rails 35 to maintain the low profile of the marker.

It is to be noted that the sloping side surfaces 37 extend downwardly from the rail surfaces to below the locating undersurfaces 40. Thus portions of such surfaces 37 are below the roadway surface R-S when the marker is mounted in a depression 45. Consequently, epoxy or other adhesive in depression 45 flows upwardly to partially cover the sloping side surfaces 37 and encapsulate the same upon installation, thereby serving to tightly lock the base in recess 45.

It will be recalled that the two mounting platforms 25, 25 are separated by an intervening vertical upright web wall 30 having a transverse overhanging canopy portion 31. Additionally, as shown, platforms 25 may extend a short distance into the two side rail portions, 35, 35 to form inset vertical recesses or pockets 46, 46. These pockets operate to protectively guard the outer ends of the elongated signal assemblies 17 mounted on the platforms 25 (see FIG. 1).

Figure 3:
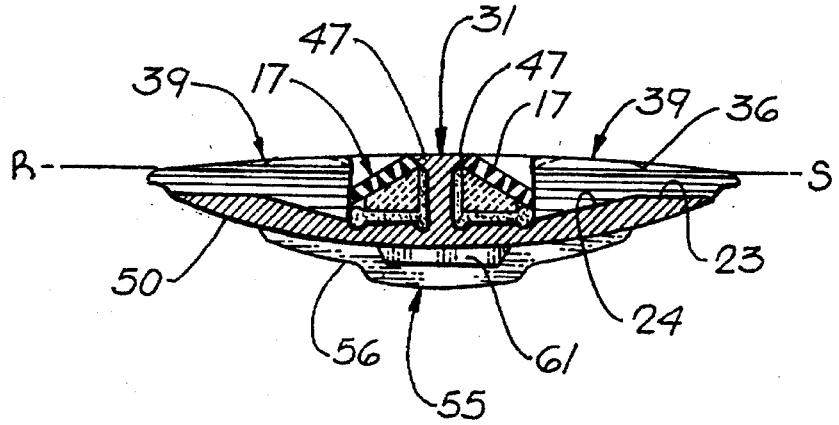
FIG. 3 is a full cross sectional view thereof, taken substantially along vantage line 3—3 of FIG. 1 and looking in the direction of the arrows thereon.
Figure 4:
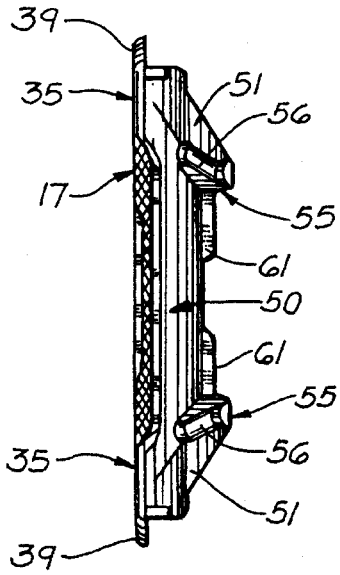
FIG. 4 is a right hand end elevational view thereof taken substantially from vantage line 4—4 of FIG. 5 and looking in the direction of the arrows thereon.
Figure 5:
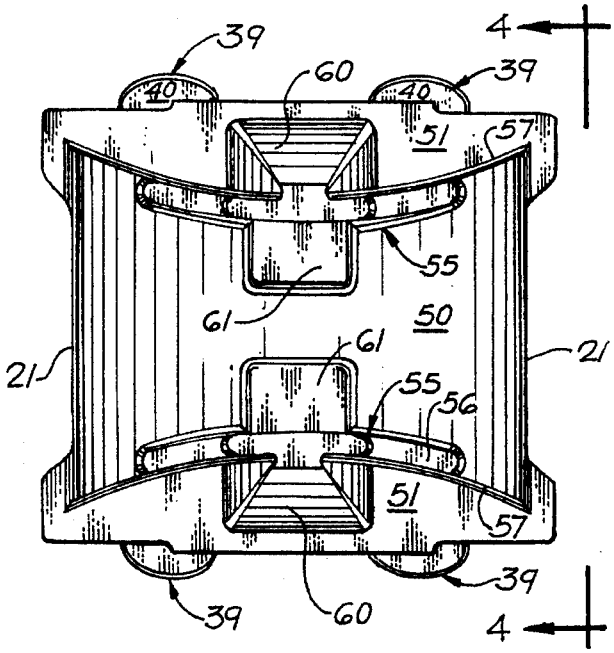
FIG. 5 is a bottom plan view thereof.
Figure 9:
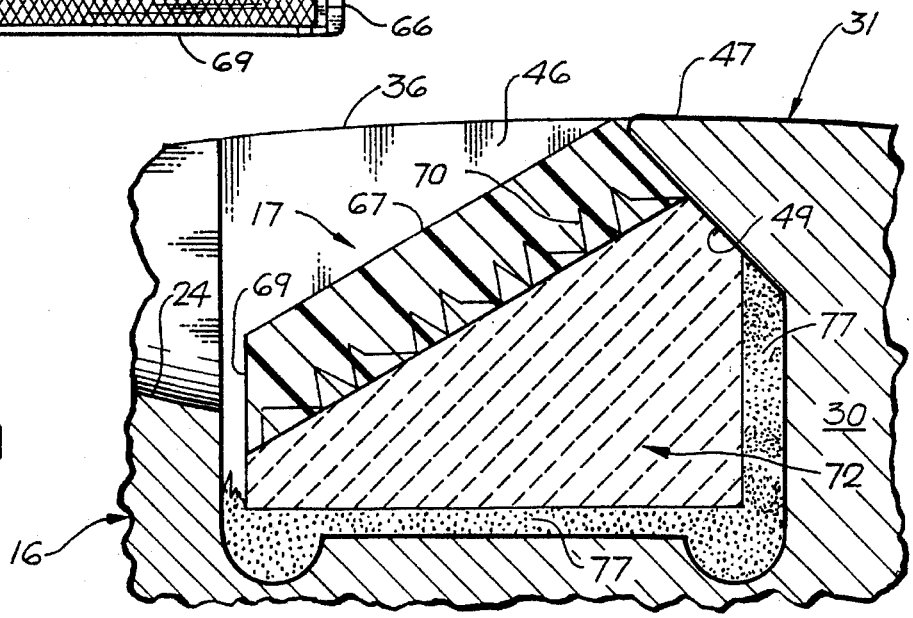
FIG. 9 is an enlarged partial cross sectional view taken substantially along vantage line 9—9 of FIG. 1 and looking in the direction of the arrows thereon.

In addition to the pockets 46, each signal assembly when mounted is uniquely guarded against plow blade contact and vehicular traffic damage by virtue of the rigid vertical web wall 30 and its protective overhanging canopy portion 31. With reference to FIGS. 3 and 9, for example, it will be appreciated that wall 30 is a substantial structure designed to withstand heavy traffic loads. Similarly the canopy portion 31 is a rugged structure formed with slightly downwardly sloping or arcuate top walls 47, 47 which are separated by and merged into the generally horizontal upper end surface 48 of the web wall 30 which lies co-planar with the upper surfaces 36, 36 of the side rails 35, 35. The underside of the canopy portion is distinguished by two downwardly angled convergent walls 49, 49 which intersect walls 47, 47 at their upper ends and slope downwardly to intersect the opposite sides of the web wall itself (see FIG. 9). The opposite ends of the canopy walls 47 and 49 are formed to angularly intersect and merge with the opposite sides of wall 30.

Having set out the features of the upper side of the base casting 16 the underside thereof will now be described with particular reference to FIGS. 2, 3, 4 and 5 of the drawings. As shown best in FIGS. 2 and 3, the side elevation of the underside of the cast base is generally arcuate, formed by a wide central arcuate portion 50 laterally flanked by two separated arcuate portions 51, 51 (see FIG. 5). It is to be noted that portion 50 is formed at a larger arcuate radius than portions 51 and therefore extends vertically downwardly in an offset manner from portions 51, 51. (See FIG. 3).

Projecting radially outwardly or operationally downward from the lateral margins of the central arcuate portion 50, substantially at the junction thereof with the laterally flanking portions 51, are a pair of generally arcuate shaped depending anchor rib members 55, 55 which have radially recessed or stepped end-portions 56, 56 along their bottom margins. Such rib members also are laterally arced in opposite directions to follow the curved margins 57 of body portion 50 with their stepped end portions 56 terminating well inwardly of ends 21 of the cast base (see FIG. 5).

Located centrally of each of the ribs 55 and extending laterally thereof toward the opposite lateral sides of base 16 beneath rails 35, 35 is a semi-pyramidal shaped web 60 which helps to locate and center base 16 laterally in depression 45 and reinforces its adjacent ribs 55. Webs 60 also serves to disperse liquid adhesive upwardly over the sides 37 of the base when the latter is mounted in the pavement recess 45. A generally rectangular parallelopiped protrusion 61 is also formed adjacent the base of each of the ribs 55, but on the opposite sides thereof from the webs 60; the two protrusions 61, 61 so provided extending toward one another and partially across the crown of the central arcuate portion 50. Protrusions 61 serve to undersupport and reinforce the central arcuate portion 50 and the signal protective web wall 30 in operation, as well as to distribute liquid adhesive over the underside of base 16 when the later is mounted in a pavement recess 45.

Turning now to FIGS. 6–9, features of the signal assembly 17 follow. While a requisite light signal assembly may be produced by any of a number of conventional means, passive light reflectors capable of retro-reflecting light from the head lights of oncoming vehicles are preferred including air gap or potted structures in accordance with the herein illustrated embodiment.

Figure 6:
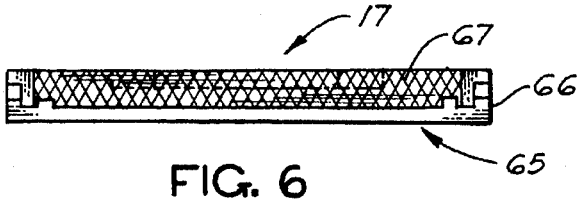
FIG. 6 is an enlarged front elevational view of a light signal assembly shown in FIG. 1.
Figure 8:
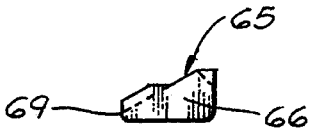
FIG. 8 is a right hand end elevational view thereof.
Figure 7:
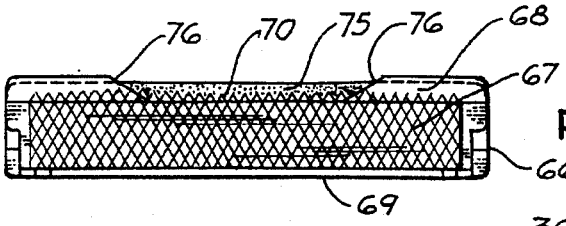
FIG. 7 is a top plan view thereof.

As shown, each signal assembly 17 comprises a potted construction having an elongated molded plastic body 65 that is generally rectangular in front elevation and plan (see FIG. 6 and but which is substantially triangular in end elevation (see FIG. 8). Consequently, body 65 has generally triangular end walls 66, 66 and an angularly sloping, rectangular, planar front wall 67 having a transversely extending horizontal top edge wall 68 and a vertical bottom edge wall 69. The end, front top and bottom walls are integrally formed to provide a transparent shell or casing open over its back and bottom sides as by casting or molding a suitable clear, hard plastic in the desired form. It is to be noted that the back face or underside of front wall 67 is further formed with a plurality of generally diamond or pyramidal shaped interstices 70 (see FIG. 7 and 9), the surfaces of which are plated with reflective material such as chromium to provide light reflective faceted surfaces according to conventional practice. Potting material indicated at 72, such as sand filled epoxy or the like, capable of forming a hard generally rigid and solid interior support for the plastic shell body 65 is employed to fill the triangular or wedge-like interior and strengthen the same against compression loads (see FIG. 9).

It will be recognized that planar top edge 68 of the front wall 67 and part of the solid interior filler support 72 are cut away intermediate the ends of assembly 17 at approximately right angles to the plane of front wall 67 to provide a downwardly sloping surface portion 75 having angularly convergent end wall portions 76, 76 which mate with and are confronted respectively by the underside faces 49 and the angularly extending ends of the overhanging canopy 31. Thus when a signal assembly 17 is mounted on one of the mounting platforms 25 it is firmly interlocked with the canopy against vertical, horizontal and lateral movements.

In order to complete the installation of a light assembly with the cast base or body 16, pads or strips of butyl mastic are applied over the bottom and portions of the back wall of the signal assembly outboard of the canopy cut out portion 75; such mastic being indicated at 77 in FIGS. 1 and 9. If desired additional butyl mastic strips also may be applied over the end walls 66 as shown.

The butyl material is particularly characterized by very high tackiness, non-hardening, non-oxidizing, non-toxic properties. Mastic 77, of course, serves to strongly adhere the signal assembly to platform 26 of a socket 25 and to web wall 30 whereby the canopy portion 31 protectively overhangs a major medial portion of the upper end of the signal assembly, as shown best in FIG. 9 of the drawings. In the event of damage to a signal assembly, such may be pried loose and removed from its mounting platform followed by replacement with a new assembly because of the non-hardening characteristics of the butyl mastic.

It will be understood that either one or two signal assemblies 17 may be mounted on the marker base, as selected, to provide either unidirectional or bidirectional retro-reflective signal activity for the marker as desired.

In general, a marker assembly in accordance with this invention provides several marked advantages over the prior art. In particular by interlocking the light signal assemblies with the base casting through the provision of the canopy and the load resisting functioning of the web wall 30, each signal is locked in place both vertically and horizontally while the front to back movement thereof is substantially eliminated by virtue of wall 30 and the underlying mounting platform and mastic. It is to be noted in this regard that any impact with a passing vehicle tire tends to wedge the reflector assembly toward the web wall 30 thereby increasing the downward wedging action of the canopy. Additionally vertical loads are shielded from the light assemblies by virtue of the rigid canopy and rugged web wall 30. Direct vertical impact between the light assembly and a vehicle tire or a snow plow blade is prevented by the canopy particularly over the middle section thereof, while the top edge portions lying outboard of the canopy are purposely narrow and the spacing between such rails 35 is purposely less than the width of the vehicle tires so that tire contact of a light assembly is largely opposed and eliminated by the canopy and side rails of the marker body.

Although the heretofore described preferred embodiment of this invention specifies that the vertical web wall 30 with which the signal assembly or assemblies 17 are interlocked be formed integrally with the marker's cast base 16, it is fully contemplated that the web wall and its associated signal assemblies may be removably separate from base 16. In addition, although a specific signal assembly is hereinabove described, air gap or other reflector structures are readily adaptable for the light reflective function of the assembly.

Due to the very low profile of the marker assembly of this invention minimal interference with snow plow blade and vehicle tire passage thereover is achieved.

Due to the square or rectangular configuration and overall rather shallow vertical dimensions of the cast base (approximately 1½") the depression cut in the roadway is correspondingly small and shallow, creating minimal disturbance of the roadway which affords simplified installation using a single depth cut by means of a gang of relatively small saw blades or uniform radius.

Because of the oppositely curved rib members 55 and related lateral protrusions and webs, improved resistance to longitudinal displacement of the installed marker is achieved as opposed to currently used anchor members which are straight or linear.

When installing a marker of this invention in the pavement recess, which is semi-filled with liquid epoxy or other suitable adhesive, the casting's bottom configuration, especially the protrusions and webs adjacent the rib members serve to evenly distribute the adhesive throughout the cavity and provide additional anti-displacement means once the adhesive is set.

Of added importance is the fact that the epoxy adhesive in filling the roadway depression 45, flows over the outer ends of the cast base and partially over the outer ends of the ramp surfaces 23 as well as partially over the side rail surfaces 37. This serves to partially encapsulate the base casting and enhance retention thereof in the depression 45 in operation.

In view of the foregoing it is believed that those skilled in the art will appreciate that this invention represents a marked advancement over the prior art and will readily understand that while the same has been described herein and illustrated in association with a particular preferred embodiment, it is susceptible to variation, modification and substitution of equivalents without departing from the spirit and scope of the invention hereof which is intended to be unlimited by the foregoing except as may appear in the following appended claims.

The embodiments of the invention in which an exclusive property or privilege is claimed are defined as follows:

1. A low-profile, bi-directionally snow-plowable, pavement marker for delineating roadway traffic lanes, comprising:

a unitary metal base of substantially square plan configuration adapted to be mounted and adhesively secured in a single shallow concave depression of uniform radius formed in a roadway surface;

said base having a generally arcuately formed underside receptive in said depression distinguished by a pair of curved, laterally concave-convex and vertically convex, arcuate rib members formed on said underside with the laterally concave sides thereof facing opposite lateral sides of said base;

a pair of sub-road surface, oppositely inclined, symmetrically disposed planar vision ramps recessed in the upper side of said base to extend angularly downwardly from adjacent opposite ends thereof with the lower ends of said ramps terminating near the central transverse axis of said base;

a pair of sub-road surface, co-planar parallel mounting platforms located between and extending transversely across said lower ends of said ramps;

a rigid, vertical wall aligned along said transverse axis and formed to separate and partially overhang said mounting platforms;

a pair of parallel linear side rails laterally flanking said ramps, platforms and wall and forming said lateral sides of said base;

said rails having low profile, convex upper surfaces of substantially uniform radius extending in low profile arcs between the roadway surface and the upper end of said wall; and locator means providing co-planar undersurfaces extending laterally of said rails for engaging the roadway surface whereby to vertically locate said base in said depression and having convex curvelinear upper surfaces which merge with and extend between the upper surfaces of said rails and the roadway surface whereby to guide a snowplow blade thereover.

2. The combination of claim 1, and a light signal assembly mounted on at least one of said mounting platforms, adhesive means anchoring a said assembly to said vertical wall and an associated said mounting platform, each said signal assembly having a cutaway portion at the upper end thereof, and a canopy portion formed integral with said vertical wall to extend transversely outward thereof and protectively overhang the upper end of said signal assembly, said canopy portion having converging undersurfaces which matingly engage and interlock with the cutaway portion of a said signal assembly whereby to substantially prevent displacement of said assembly.

3. The combination of claim 2, wherein a said signal assembly comprises a planar transparent front wall extending across and angularly upwardly from adjacent the lower end of a said vision ramp, said front wall having a plurality of light reflective facets along its underside for producing retro-reflective signals in the presence of light transmitted thereto along a related said ramp.

4. The combination of claim 1, and web portions extending laterally from the outboard sides and additional protrusions extending from the inboard sides of said rib members for reinforcing said base and wall against vertical loads and for distributing liquid adhesive employed to anchor said base in said depression.

5. The combination of claim 1, wherein said underfaces of said locator means serve to position such base vertically in said roadway depression such that when the latter is semi-filled with liquid adhesive, the same is distributed over the underside of said base and to the level of the roadway surface whereby to encapsulate the ends and sides of said base.

6. The combination of claim 2, wherein said vertical wall is integral with said side rails and said canopy portion extends partially along the upper end of said wall.

7. The combination of claim 2, wherein the lateral spacing between said side rails and the extent of said canopy and wall cooperate to substantially prevent direct contact of a said signal assembly by vehicle tires and snow plow equipment passing thereover.

8. The pavement marker of claim 2, wherein the upper side of said base is arcuate from front to back with the highest point of its arc occurring at and along its central transverse axis at the upper end of said canopy portion.

* * * * *

UNITED STATES PATENT AND TRADEMARK OFFICE

CERTIFICATE OF CORRECTION

PATENT NO. : 5,454,664

DATED : 10/3/95

INVENTOR(S) : Allen D. Siblik

It is certified that error appears in the above-identified patent and that said Letters Patent is hereby corrected as shown below:

Col. 5, line 18, after "6 and" insert -- 7), --;

Signed and Sealed this

Nineteenth Day of December, 1995

Bruce Lehman

*Attest:*

BRUCE LEHMAN

*Attesting Officer*

*Commissioner of Patents and Trademarks*